US006189184B1

(12) United States Patent
Pferdmenges et al.

(10) Patent No.: US 6,189,184 B1
(45) Date of Patent: Feb. 20, 2001

(54) CARDING MACHINE HAVING AN ADJUSTABLE STATIONARY CARDING SEGMENT

(75) Inventors: Gerd Pferdmenges, Jüchen; Armin Leder, Mönchengladbach, both of (DE)

(73) Assignee: Trützschler GmbH & Co. KG, Mönchengladbach (DE)

( * ) Notice: Under 35 U.S.C. 154(b), the term of this patent shall be extended for 0 days.

(21) Appl. No.: 09/263,764

(22) Filed: Mar. 5, 1999

(30) Foreign Application Priority Data

Mar. 5, 1998 (DE) ..... 198 09 330

(51) Int. Cl.[7] ..... D01G 15/02
(52) U.S. Cl. ..... 19/104; 19/110; 19/113
(58) Field of Search ..... 19/98, 99, 102, 19/104, 110, 111, 113, 114

(56) References Cited

U.S. PATENT DOCUMENTS

| | | | | |
|---|---|---|---|---|
| 2,879,549 | * | 3/1959 | Miller et al. | 19/104 |
| 4,286,357 | | 9/1981 | Harrison, Sr. . | |
| 4,539,728 | | 9/1985 | Portell . | |
| 4,593,437 | * | 6/1986 | Graf et al. | 19/113 |
| 4,947,522 | * | 8/1990 | Staehli | 19/104 |
| 4,972,552 | * | 11/1990 | Graf | 19/113 |
| 5,022,121 | * | 6/1991 | Rutz | 19/102 |
| 5,142,742 | | 9/1992 | Erni et al. . | |
| 5,398,381 | * | 3/1995 | Schlichter et al. | 19/102 |
| 5,530,994 | * | 7/1996 | Loeffler | 19/104 |

FOREIGN PATENT DOCUMENTS

| | | |
|---|---|---|
| 681 546 | 4/1993 | (CH) . |
| 36 01 906 | 4/1988 | (DE) . |
| 39 02 204 | 8/1990 | (DE) . |
| 295 673 | 11/1991 | (DE) . |
| 93 13 633 | 2/1994 | (DE) . |
| 0 144 607 | 6/1985 | (EP) . |
| 0 794 272 | 9/1997 | (EP) . |

* cited by examiner

*Primary Examiner*—Danny Worrell
*Assistant Examiner*—Gary L. Welch
(74) *Attorney, Agent, or Firm*—Venable; Gabor J. Kelemen

(57) ABSTRACT

A carding machine includes a machine frame; a fiber processing roll carrying a roll clothing and having a rotary axis; and a stationary carding segment including a carrier mounted on the machine frame; and two carding elements affixed to the carrier and arranged serially as viewed circumferentially of the roll. Each carding element has an element clothing for cooperating with the roll clothing. The carding segment further has a mechanism for turning the carding elements as a unit about a turning axis extending parallel to the rotary axis of the roll for adjusting a distance of the element clothings from the roll clothing.

17 Claims, 6 Drawing Sheets

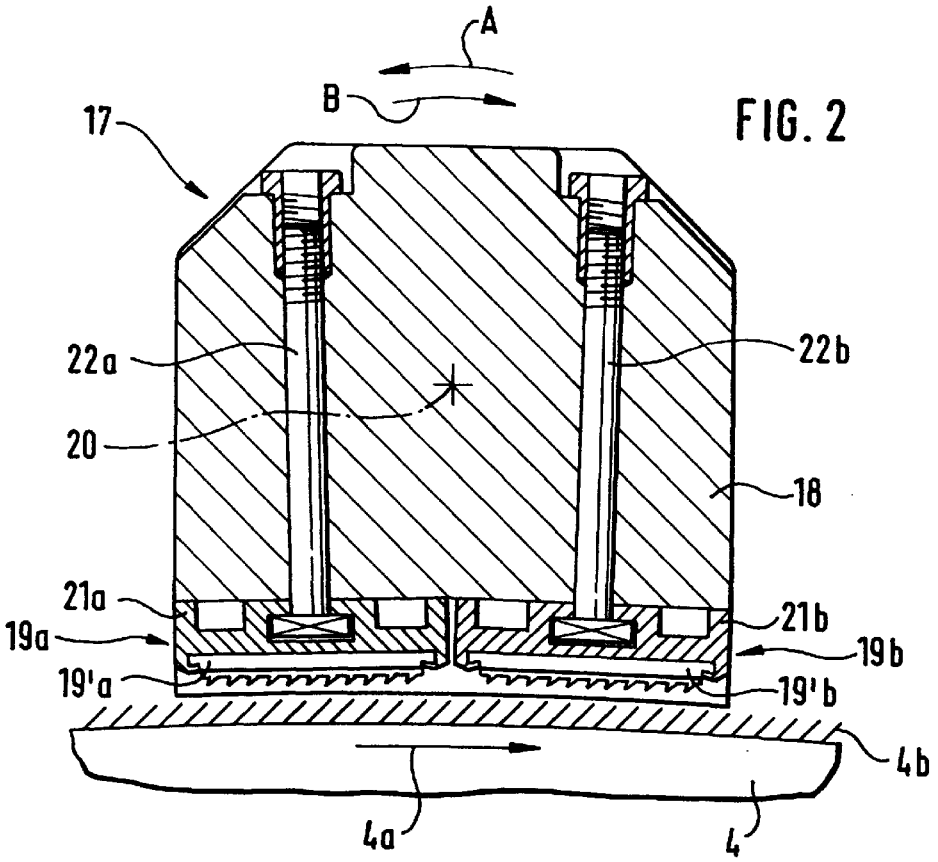
FIG. 2
FIG. 3a
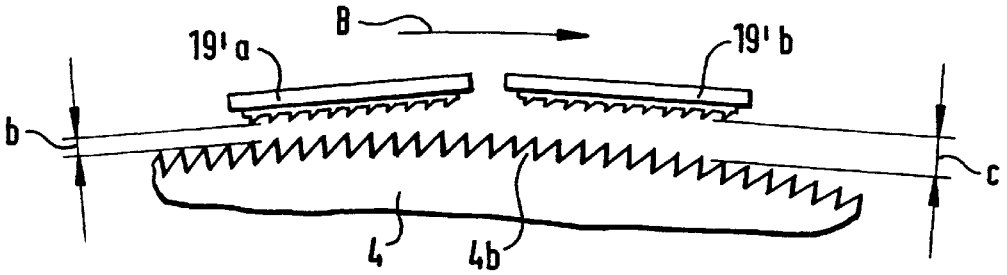
FIG. 3b
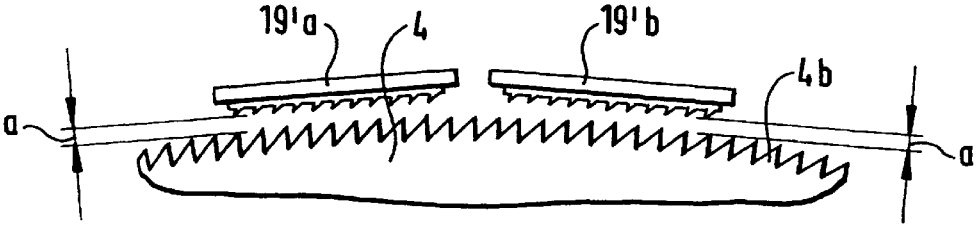

CARDING MACHINE HAVING AN ADJUSTABLE STATIONARY CARDING SEGMENT

CROSS REFERENCE TO RELATED APPLICATION

This application claims the priority of German Application No. 198 09 330.6 filed Mar. 5, 1998.

BACKGROUND OF THE INVENTION

This invention relates to a carding machine which has at least one stationary carding segment cooperating with a roll (for example, the main carding cylinder) of the carding machine. The stationary carding segment has a carrier on which two carding elements are mounted which are situated serially as viewed in the direction of roll rotation. The clothing of the carding elements and the clothing of the roll cooperate with one another. The stationary carding segment is adjustable relative to the roll with which it cooperates. In a known arrangement of the above-outlined type, as disclosed in published European Application 0 144 607, a carding plate mounted on a carrier has at least two tooth fields which are arranged fixedly relative to one another. The carding plate may be adjusted as a whole so that the tooth fields do not need any individual adjustment. The tooth points of a tooth field may be arranged along an imaginary cylindrical surface whose radius approximately corresponds to that of the carding cylinder. As a result, the clothing of the stationary carding plate, on the one hand, and the cylinder clothing, on the other hand, are arranged parallel to one another. In case the distance between the facing clothings is increased or reduced, the ratio of the radii of curvature along which the clothings are arranged changes. As a disadvantageous result, the curvatures along which the clothing points are arranged change with respect to one another such that different distances between the facing clothings will appear. It is thus a drawback that the carding clearance changes such that the carding operation and the quality of the carded product are adversely affected. A purposeful adjustment to a desired carding gap cannot be effected by the known device.

SUMMARY OF THE INVENTION

It is an object of the invention to provide an improved adjustable stationary carding segment of the above-outlined type from which the discussed disadvantages are eliminated and which, in particular, makes possible an accurate setting and an adjustment of the distances of facing clothings in a simple manner.

This object and others to become apparent as the specification progresses, are accomplished by the invention, according to which, briefly stated, the carding machine includes a machine frame; a fiber processing roll carrying a roll clothing and having a rotary axis; and a stationary carding segment including a carrier mounted on the machine frame; and two carding elements affixed to the carrier and arranged serially as viewed circumferentially of the roll. Each carding element has an element clothing for cooperating with the roll clothing. The carding segment further has a mechanism for turning the carding elements as a unit about a turning axis extending parallel to the rotary axis of the roll for adjusting a distance of the element clothings from the roll clothing.

By providing for a rotatability of both carding elements jointly about an axis of rotation, desired distances between the facing carding clothings may be set in a simple manner.

Since the two carding elements are rigidly interconnected, an exact adjustment of the two clothings of the carding elements relative to the cylinder clothing is possible. Particularly in case of planar clothing surfaces of the two carding elements, it is feasible to arrange both carding surfaces at the same distance from, and approximately tangentially to, the clothing surface of the cylinder; as a result, the carding gap has a substantially uniform width. This is particularly the case when the clothings of the carding elements are short. The device according to the invention also makes a setting of a desired flaring or tapering course of the carding gap feasible in a simple manner. The distances between the facing carding clothings may be set in a simple and purposeful manner according to the invention.

While it is known from published European Application 152 053 to adjust a distance between the clothings of the carding elements, on the one hand, and the cylinder clothing, on the other hand, the individual adjustment of each carding element, however, is structurally complex and the carding clearance lacks uniformity.

The invention has the following additional advantageous features:

- The carding elements are mounted inside the carrier and are rotatable together.
- The carding elements are rotatable together with the carrier.
- The carding elements are rotatable relative to a securing surface.
- The carrier is rotatably mounted.
- The rotary axis passes through a midpoint between the carding elements.
- The rotary axis is situated in the end region of one of the carding elements.
- An adjusting device is provided at one end of the carrier.
- The adjusting device has at least one setscrew.
- The carrier is associated with a rotary joint.
- The rotary joint has, at the carrier, a movable bent surface which is in engagement with a stationary bent surface.
- The rotary joint is aligned with the longitudinal central axis of the carrier.
- At least one setscrew passes through an opening in the carrier.
- The setscrew engages a stationary counter support.
- The contacting end of the setscrew is spherical.
- The setscrew has a counternut.
- The carrier is, at both ends, mounted on a stationary counter support by means of a securing element, for example, securing screws.
- One of the securing screws sets the distance between the carrier and the counter support.
- The carrier and/or the carding elements may be immobilized.
- At least one stationary carding element structured according to the invention is arranged in the pre-carding zone between the licker-in and the rearward sprocket supporting the traveling flats.
- At least one stationary carding segment structured according to the invention is disposed in the post-carding zone between the doffer and the frontal sprocket which supports the traveling flats.
- At least one stationary carding segment structured according to the invention is disposed in the lower carding region between the doffer and the licker-in.

In case only stationary flats elements are associated with the carding cylinder, a plurality of stationary carding segments structured according to the invention are disposed along the carding cylinder.

BRIEF DESCRIPTION OF THE DRAWINGS

FIG. 2 is a sectional side elevational view of a carding segment according to a preferred embodiment of the invention.

FIG. 3*a* is a schematic side elevational view illustrating two carding elements showing their relative position with respect to a carding cylinder clothing before adjustment.

FIG. 3*b* is a view similar to FIG. 3*a,* illustrating the carding elements after adjustment.

DESCRIPTION OF THE PREFERRED EMBODIMENTS

Figure 1:
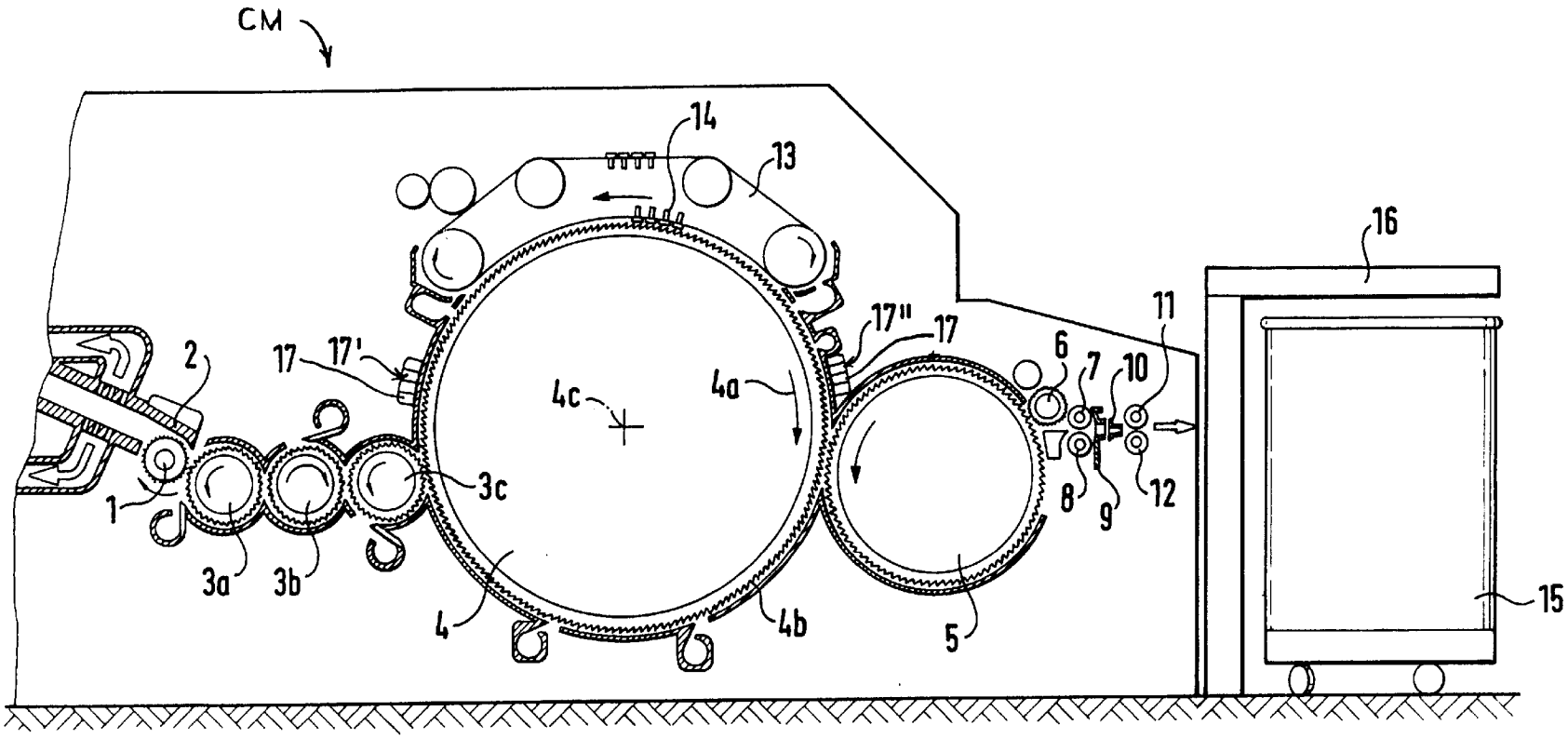
FIG. 1 is a schematic side elevational view of a carding machine incorporating carding segments structured according to the invention.

FIG. 1 schematically illustrates a carding machine CM which may be, for example, an EXACTACARD DK 803 model, manufactured by Trützschler GmbH & Co. KG, Mönchengladbach, Germany. The carding machine CM has a feed roll 1, a feed table 2 cooperating therewith, licker-ins 3*a,* 3*b* and 3*c,* a main carding cylinder 4, a doffer 5, a stripper roll 6, crush rolls 7, 8, a web guiding element 9, a sliver forming trumpet 10, calender rolls 11, 12, a traveling flats assembly 13, flat bars 14 forming part of the assembly 13, a coiler can 15, a sliver coiler mechanism 16 and stationary carding segment groups 17', 17" each formed of a plurality of carding segments 17 structured according to the invention. The carding cylinder 4 which is provided with a circumferential clothing 4*b* rotates in the direction of the arrow 4*a* about a central axis 4*c*.

Turning to FIG. 2, the carding segment 17 includes a carrier 18 and two carding elements 19*a,* 19*b* which are arranged serially as viewed in the rotary direction 4*a* of the carding cylinder 4. The clothings 19'*a* and 19'*b* of the respective carding elements 19*a* and 19*b* face the clothing 4*b* of the carding cylinder 4. The carding elements 19*a,* 19*b* are rotatable together as a rigid unit about an axis 20 which extends through the middle of the carrier 18 and which is parallel to the cylinder axis 4*c* (shown in FIG. 1). The distance between the clothings 19'*a,* 19'*b* of the respective carding elements 19*a,* 19*b* from the cylinder clothing 4*b* is thus adjustable in a simple manner.

Figure 4:
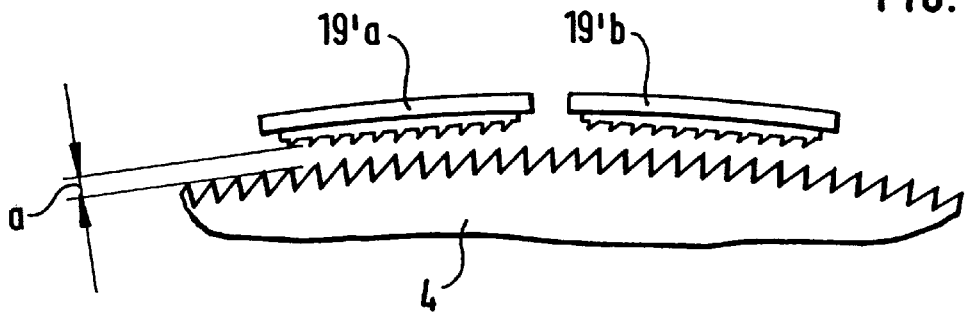
FIG. 4 is a schematic side elevational view illustrating two carding elements having curved clothings.

On the carrier 18 two holders 21*a,* 21*b* are mounted to which sawtooth wire strips constituting the clothings 19'*a* and 19'*b* are secured, for example, by clamps. The holders 21*a,* 21*b* are arranged directly behind one another as viewed in the carding direction so that between the individual clothings 19'*a* and 19'*b* only a small clearance is present and thus both axially and circumferentially a substantially continuous working surface is obtained. The clothings 19'*a* and 19'*b* extend in the carding direction substantially over the entire dimension of the respective holders 21*a* and 21*b*. In case planar clothings 19'*a* and 19'*b* made of straight sawtooth strips are used, the working surface is formed of two faces which are tangential to the clothing 4*b* of the carding cylinder 4. Thus, as shown in FIG. 3*b,* each tangential surface has a minimum linear distance a from the clothing 4*b* of the carding cylinder 4. FIG. 3*a* schematically shows the carding elements 19*b,* 19'*b* of a carding segment before rotation, at which time the smallest distance b and c between the clothings 19'*a* and 19'*b* from the cylinder clothing 4*b* are different. FIG. 3*b* shows the arrangement after rotation, at which time the smallest distances a of the clothings 19'*a* and 19'*b* from the cylinder clothing 4*b* are identical to one another. In case the radii of curvature of the clothings 19'*a* and 19'*b* correspond to the radius of curvature of the clothing 4*b* of the cylinder 4, the clearance a is constant, as shown in FIG. 4. The distance of the clothings 19'*a* and 19'*b* from the cylinder clothing 4*b* may be adjusted by rotating the carding segment 17 about the rotary axis 20 with the carding elements 19*a,* 19*b*. The carrier 18 which accommodates the holders 21*a* and 21*b* is made, for example, of extruded aluminum and is substantially resistant to bending. The carrier 18 extends over the entire width of the carding work zone. The holders 21*a,* 21*b* are bar-like members which are releasably secured to the carrier 18 by means of screws 22*a,* 22*b* that pass through bore holes provided in the carrier 18. The holders 21*a,* 21*b* and the respective clothings 19'*a* and 19'*b* together constitute the carding elements 19*a* and 19*b,* respectively. By virtue of the fact that the carding elements 19*a* and 19*b* are fixedly mounted on the carrier 18 and are rigidly arranged with respect to one another and further, that the carrier 18 is supported for rotation about the axis 20 in the direction of the arrows A and B, the clothings 19'*a* and 19'*b* are also rotatable about the rotary axis 20.

Figure 5:
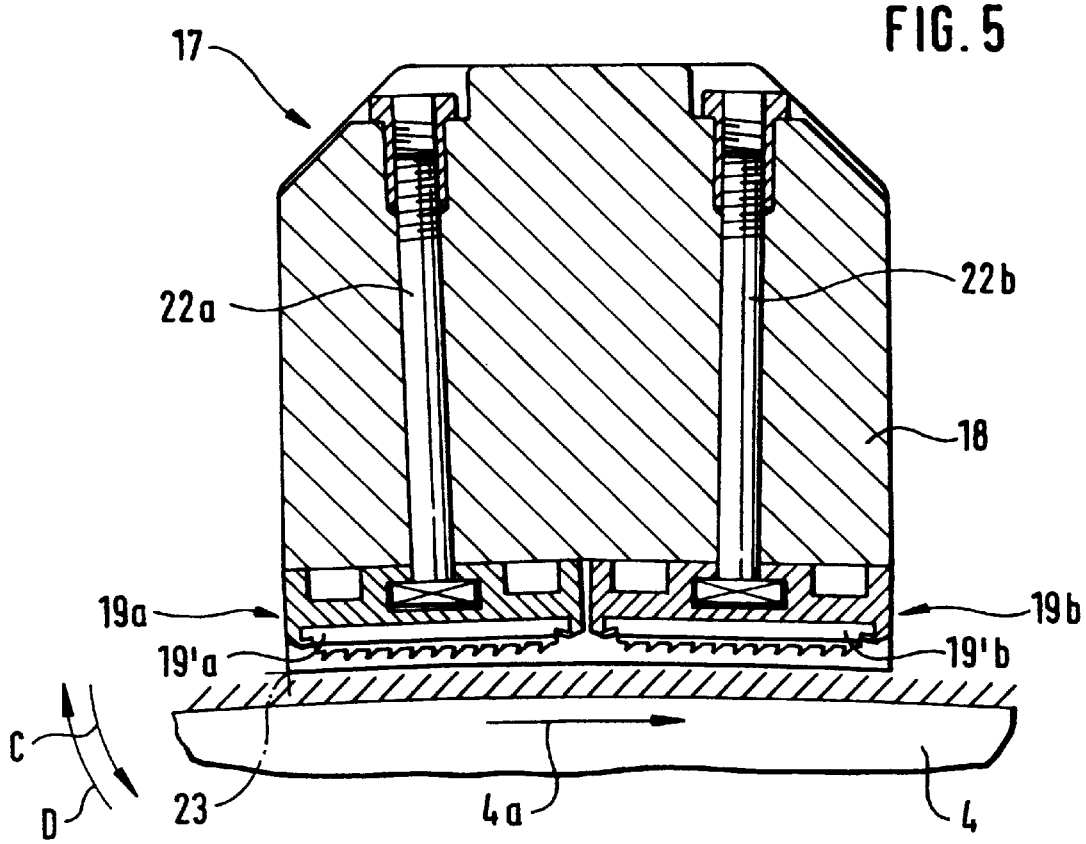
FIG. 5 is a sectional side elevational view of a carding segment according to the invention having an eccentric axis of rotation.

In the embodiment shown in FIG. 5 the rotary axis 23 of the carding segment 17 is situated at the outer terminal region of the carding element 19*a*. The rotary axis 23 is eccentric relative to the cross section of the carrier 18. The carding segment 17 is rotatable about the rotary axis 23 in the direction of the arrows C and D.

Figure 6A:
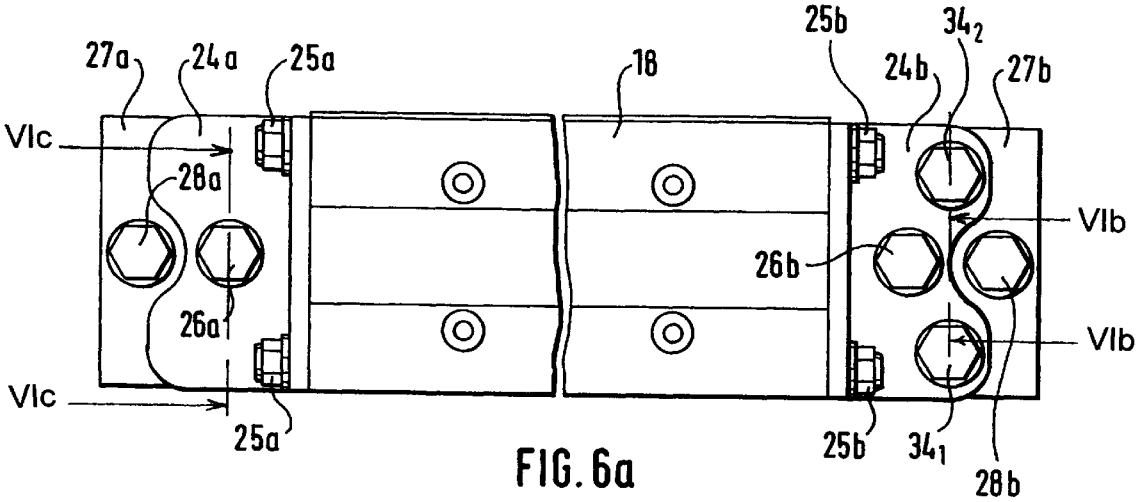
FIG. 6*a* is a top plan view of a securing arrangement at both ends of a carding segment according to the invention.
Figure 7:
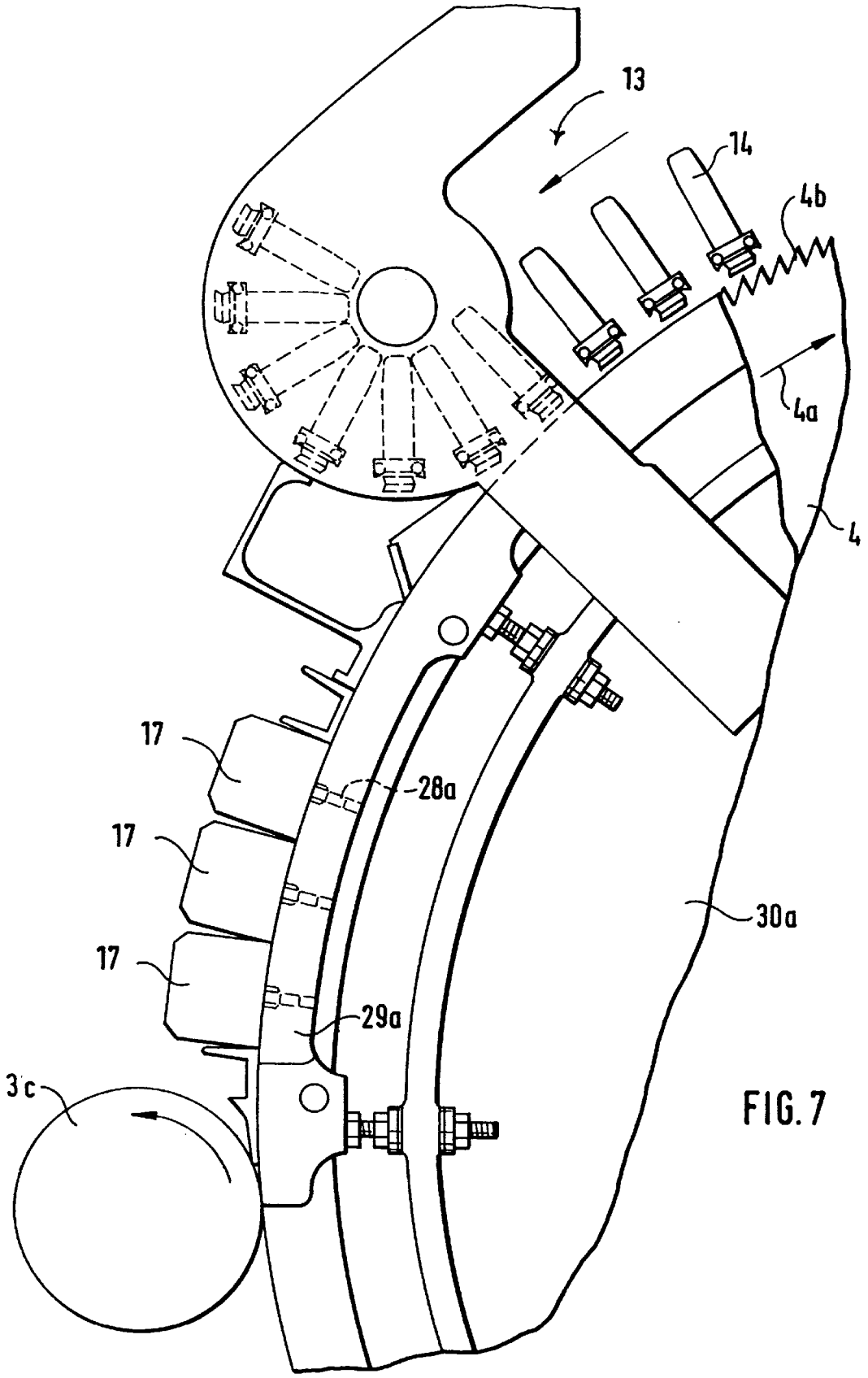
FIG. 7 is a fragmentary sectional side elevational view of the pre-carding zone of a traveling flats-type carding machine showing three stationary carding segments according to the invention.

Turning to FIGS. 6*a,* 6*b* and 6*c,* to both ends of the carrier 18 respective terminal elements 24*a* and 24*b* are secured which are essentially formed of two perpendicularly arranged plate members 24*a*', 24*a*' and, respectively, 24*b*', 24*b*". The plates 24*a*' and 24*b*' are secured to the carrier 18 by respective screws 25*a* and 25*b*. The plates 24*a*" and 24*b*" are each traversed by respective screws (holding posts) 26*a,* 26*b* which engage a thread provided in the respective securing plates 27*a* and 27*b*. The securing plates 27*a,* 27*b* are mounted by means of screws 28*a,* 28*b* on extension bends which, in turn, are attached to carding frame shields on either side of the carding cylinder 4. FIG. 7 shows only the extension bend 29*a* and the carding frame shield 30*a* on one side of the cylinder 4. The screws 26*a* and 26*b* pass through respective compression springs 31*a,* 31*b* which, with one end, engage the heads of the screws 26*a,* 26*b* and with another end engage a planar face of respective spring supporting disks 32*a,* 32*b*. The convex reverse surface of the supporting disks 32*a,* 32*b* is seated in the concave face of bearing disks 33*a,* 33*b,* respectively, so that the supporting disks 32*a* and 32*b* form swivel bearings together with the respective bearing disks 33*a,* 33*b*. The bearing disks 33*a* and 33*b* are secured to the upper face of the respective plate 24*a*" and 24*b*".

Figure 6B:
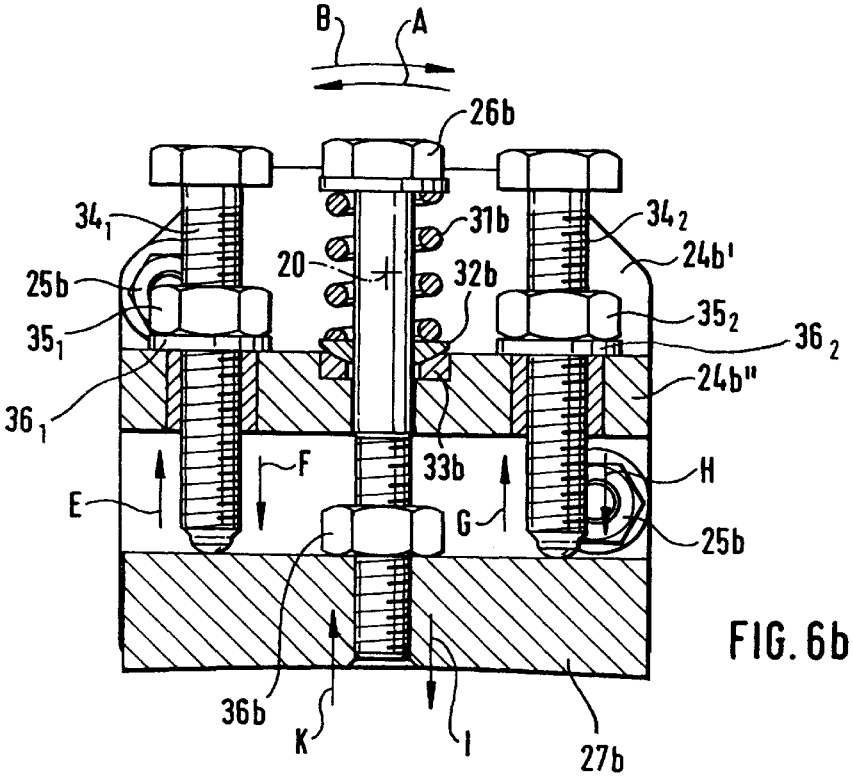
FIG. 6*b* is a sectional view taken along line VIb—VIb of FIG. 6*a*.

As shown in FIG. 6*b,* two setscrews $\mathbf{34}_1$ and $\mathbf{34}_2$ are provided which pass through bushings in bore holes provided in the plate 24*b*" and engage the upper surface of the securing plate 27*b* with their spherical end face. The setscrews $\mathbf{34}_1$ and $\mathbf{34}_2$ are provided, above the securing plate 27*b,* with respective counternuts $\mathbf{35}_1$, $\mathbf{35}_2$ and washers $\mathbf{36}_1$, $\mathbf{36}_2$. When the setscrew $\mathbf{34}_1$ is rotated such that it is axially displaced in the direction of the arrow E, the plate 24*b*" and all components which are rigidly connected with the plate 24*b*" tilt in the direction of the curved arrow A about the rotary axis 20, as urged by the springs 31*a,* 31*b*. When the setscrew $\mathbf{34}_1$ is caused to be axially displaced in the opposite direction, that is, in the direction of the arrow F, the plate 24*b*" is tilted against the force of the springs 31*a,* 31*b* in the direction of the arrow B. Likewise, the plate 24*b*" is tilted in the direction of the arrow A or B when the setscrew $\mathbf{34}_2$ is axially advanced or retracted in the direction of the arrows H or G, respectively. The setscrews $\mathbf{34}_1$ and $\mathbf{34}_2$ may be individually turned while leaving the respective other setscrew stationary. Also, both setscrews $\mathbf{34}_1$ and $\mathbf{34}_2$ may be moved in the respective opposite direction (E, H or F, G). By turning the setscrews $\mathbf{34}_1$ and $\mathbf{34}_2$ in the above-outlined manner, the carrier 18 and the carding elements 19*a,* 19*b* secured to the carrier 18 are tilted in unison in the same direction about the axis 20. As a result, the distance a or b of the clothings 19'*a* and 19'*b* from the cylinder clothing 4*b* may be adjusted to a desired extent. If required, the distance a may be set to the same value, as shown in FIGS. 3*b* and 4. It may, however, be also expedient to set unlike distances b and c (FIG. 3*a*), for example, when a flaring or tapering carding clearance is desired.

Figure 6C:
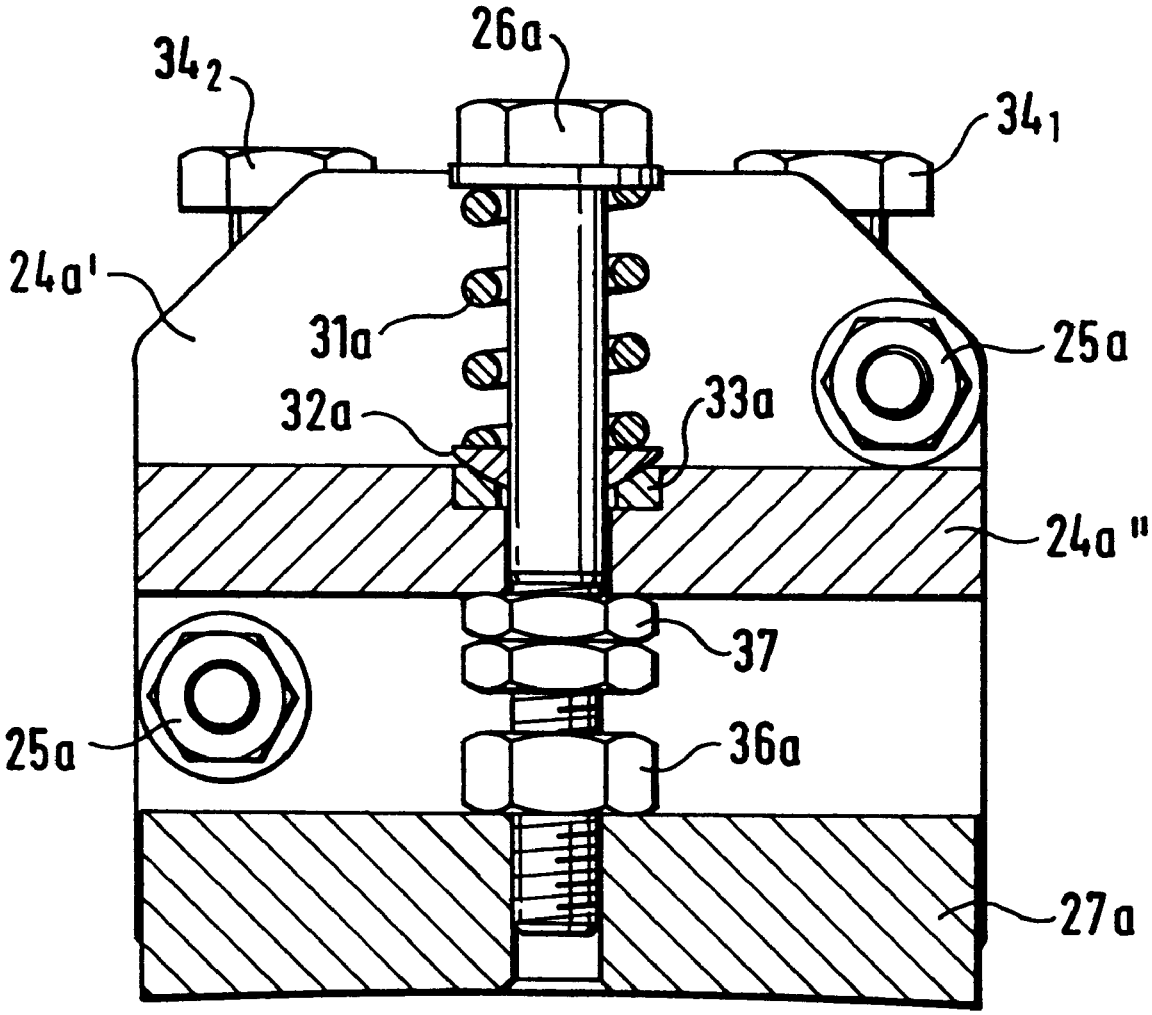
FIG. 6*c* is a sectional view taken along line VIc—VIc of FIG. 6*a*.

As shown in FIGS. 6*b* and 6*c,* underneath the plates 24*a*", 24*b*" the screws 26*a*, 26*b* carry respective counternuts 36*a,* 36*b* which engage the upper face of the securing plates 27*a,* 27*b*. In case the screw 26*b* is turned such that it travels axially in the direction of the arrow I, the plate 24*b*" is, by the pressure of the spring 31*b* exerted through the swivel bearing 32*b,* 33*b,* pressed downwardly so that at that terminal zone of the carding segment 17 the distance of the clothings 19'*a* and 19'*b* from the cylinder clothing 4*b* can be reduced. Such distance may be increased in case the screw 26*b* is caused to be displaced axially in the direction of the arrow K. As a result, the distance of the carding segment 17, that is, the distance of the clothings 19'*a,* 19'*b* from the cylinder clothing 4*b* may be set for the entire width of the carding machine to a desired value, for example, to the same value at both ends of the carding segment 17. The swivel bearing 32*a,* 33*a* at the other end of the carding segment 17 also participates in such an adjustment.

The adjustable carding segment structured according to the invention advantageously simplifies and shortens the adjusting operation upon installation. It is a particular advantage of the invention that at the same time an accurate, fine adjustment of the distances of the clothings 19'*a* and 19'*b* from the cylinder clothing 4*b* may be effected by setscrews, both in the circumferential and axial directions of the cylinder 4.

It will be understood that the above description of the present invention is susceptible to various modifications, changes and adaptations, and the same are intended to be comprehended within the meaning and range of equivalents of the appended claims.

What is claimed is:

1. A carding machine comprising (a) a machine frame;

(b) a fiber processing roll carrying a roll clothing and having a rotary axis; and (c) a stationary carding segment including (1) a carrier;

(2) mounting means for attaching said carrier to said machine frame;

(3) a plurality of carding elements affixed to said carrier and being arranged serially as viewed circumferentially of the roll; said carding elements being two in number; each said carding element having an element clothing for cooperating with said roll clothing; and (4) means for turning said two carding elements solely as a unit about a turning axis extending parallel to said rotary axis of said roll for adjusting a distance of said element clothings from said roll clothing.

2. The carding machine as defined in claim 1, wherein said means for turning includes means for turning said carrier and said carding elements as a unit.

3. The carding machine as defined in claim 1, wherein said turning axis extends between said two carding elements, at equal distances therefrom.

4. The carding machine as defined in claim 1, wherein said turning axis is located in an end region of one of said carding elements.

5. The carding machine as defined in claim 1, wherein said means for turning is located at an end of said carrier.

6. The carding machine as defined in claim 1, wherein said fiber processing roll is a main carding cylinder; further comprising a licker-in and a travelling flats assembly including travelling flats, an endless belt carrying said travelling flats and front and rear end sprockets supporting said endless belt; said stationary carding segment being positioned in a pre-carding zone between said licker-in and said rear end sprocket.

7. The carding machine as defined in claim 1, wherein said fiber processing roll is a main carding cylinder; further comprising a doffer and a travelling flats assembly including travelling flats, an endless belt carrying said travelling flats and front and rear end sprockets supporting said endless belt; said stationary carding segment being positioned in a post-carding zone between said doffer and said front end sprocket.

8. The carding machine as defined in claim 1, wherein said fiber processing roll is a main carding cylinder; further comprising a doffer and a licker-in; said stationary carding segment being positioned in a lower carding zone between said doffer and said licker-in.

9. The carding machine as defined in claim 1, wherein said roll has an axially measured length; said carrier has a length extending along the roll length and opposite longitudinal ends; further comprising an adjusting screw in a region of at least one of said longitudinal ends of said carrier for varying an angular position of said carrier relative to said rotary axis of said roll for adjusting a distance of said element clothings from said roll clothing along said rotary axis of said roll.

10. A carding machine comprising (a) a machine frame;

(b) a fiber processing roll carrying a roll clothing and having a rotary axis; and (c) a stationary carding segment including (1) a carrier;

(2) a mounting plate affixed to said machine frame;

(3) a tiltable plate affixed to said carrier for moving therewith as a unit;

(4) a holding post secured to said mounting plate and passing through said tiltable plate; said tiltable plate being tiltable with respect to said holding post;

(5) two setscrews threaded through said tiltable plate; each said setscrew having a free end contacting said mounting plate, whereby upon turning either setscrew relative to the other setscrew causes a tilting adjustment of said tiltable plate relative to said mounting plate about an axis extending parallel to said rotary axis of said roll; and (6) two carding elements affixed to said carrier for moving therewith as a unit; said carding elements being arranged serially as viewed circumferentially of the roll; each said carding element having an element clothing for cooperating with said roll clothing; upon performing said tilting adjustment of said tiltable plate, a distance of said element clothings from said roll clothing is adjusted.

11. The carding machine as defined in claim 10, wherein said holding post is a holding and adjusting screw threaded into said mounting plate for varying a distance of said tiltable plate from said mounting plate by turning said holding and adjusting screw.

12. The carding machine as defined in claim 10, wherein said free end of said setscrews is spherical.

13. The carding machine as defined in claim 10, further comprising a counter nut carried by at least one of said setscrews.

14. The carding machine as defined in claim 10, further comprising a spring urging said tiltable plate toward said mounting plate and said setscrews into contact with said mounting plate.

15. The carding machine as defined in claim 14, wherein said spring surrounds said holding screw.

16. The carding machine as defined in claim 15, further comprising a spring supporting disk having a curved surface; a seating disk disposed in said tiltable plate and complementally receiving said spring supporting disk; said spring supporting disk and said seating disk together forming a swivel joint for said tiltable plate.

17. The carding machine as defined in claim 16, wherein said carrier has a central longitudinal axis oriented parallel to said rotary axis of said roll; said swivel joint being aligned with said central longitudinal axis.

* * * * *